US009534595B2

(12) United States Patent
Akatsuka et al.

(10) Patent No.: US 9,534,595 B2
(45) Date of Patent: Jan. 3, 2017

(54) VARIABLE DISPLACEMENT VANE PUMP

(71) Applicant: KAYABA INDUSTRY CO., LTD., Minato-ku, Tokyo (JP)

(72) Inventors: Koichiro Akatsuka, Gifu (JP); Tomoyuki Fujita, Gifu (JP); Masamichi Sugihara, Gifu (JP); Fumiyasu Kato, Aichi (JP)

(73) Assignee: KYB Corporation, Tokyo (JP)

( * ) Notice: Subject to any disclaimer, the term of this patent is extended or adjusted under 35 U.S.C. 154(b) by 0 days.

(21) Appl. No.: 14/431,778

(22) PCT Filed: Sep. 20, 2013

(86) PCT No.: PCT/JP2013/075400
§ 371 (c)(1),
(2) Date: Mar. 27, 2015

(87) PCT Pub. No.: WO2014/050712
PCT Pub. Date: Apr. 3, 2014

(65) Prior Publication Data

US 2015/0240808 A1 Aug. 27, 2015

(30) Foreign Application Priority Data

Sep. 28, 2012 (JP) ..... 2012-216353

(51) Int. Cl.
*F03C 2/00* (2006.01)
*F03C 4/00* (2006.01)
(Continued)

(52) U.S. Cl.
CPC ..... *F04C 2/344* (2013.01); *F04C 2/3442* (2013.01); *F04C 14/20* (2013.01); *F04C 14/226* (2013.01);
(Continued)

(58) Field of Classification Search
CPC ..... F04C 2/344; F04C 2/3442; F04C 14/226; F04C 14/20; F04C 15/0007; F04C 15/0034
(Continued)

(56) References Cited

U.S. PATENT DOCUMENTS

2010/0034681 A1* 2/2010 Fujita ..... F04C 14/226 418/26

FOREIGN PATENT DOCUMENTS

CN 101644257 A 2/2010
JP 57-174806 U 11/1982
(Continued)

OTHER PUBLICATIONS

JP 2002-161868A, Hayashi et al., Variable Displacement Vane Pump, Jun. 7, 2002—English Translation.*
(Continued)

*Primary Examiner* — Theresa Trieu
(74) *Attorney, Agent, or Firm* — Hauptman Ham LLP

(57) ABSTRACT

A variable displacement vane pump includes: an adapter ring (a cam ring housing member) that defines a first fluid pressure chamber and a second fluid pressure chamber relative to an outer periphery of a cam ring, the cam ring being moved relative to a rotor by a differential pressure between the first fluid pressure chamber and the second fluid pressure chamber; a seal housing groove formed in an inner periphery of the adapter ring; and a slipper seal which is inserted into the seal housing groove and with which an outer periphery of the cam ring comes into sliding contact when the cam ring moves, whereby the slipper seal partitions the first fluid pressure chamber from the second fluid pressure chamber, wherein the slipper seal is formed in a thin plate shape having a square cross-section.

2 Claims, 4 Drawing Sheets

(51) Int. Cl.

| | |
|---|---|
| ***F04C 2/00*** | (2006.01) |
| ***F04C 14/18*** | (2006.01) |
| ***F04C 2/344*** | (2006.01) |
| ***F04C 14/22*** | (2006.01) |
| ***F04C 15/00*** | (2006.01) |
| ***F04C 14/20*** | (2006.01) |
| *F01C 19/00* | (2006.01) |

(52) U.S. Cl.
CPC ..... *F04C 15/0007* (2013.01); *F04C 15/0034* (2013.01); *F01C 19/005* (2013.01)

(58) Field of Classification Search
USPC ..... 418/24, 26–30, 259–260; 417/220
See application file for complete search history.

(56) References Cited

FOREIGN PATENT DOCUMENTS

| | | | |
|---|---|---|---|
| JP | 2002-161868 | A | 6/2002 |
| JP | 2004-52927 | A | 2/2004 |
| JP | 2005-337146 | A | 12/2005 |
| JP | 2006-9897 | A | 1/2006 |
| JP | 2007-107547 | A | 4/2007 |
| WO | 2006/001281 | A1 | 1/2006 |

OTHER PUBLICATIONS

International Search Report and Written Opinion mailed Dec. 17, 2013, corresponding to International application No. PCT/JP2013/075400.

* cited by examiner

VARIABLE DISPLACEMENT VANE PUMP

TECHNICAL FIELD

The present invention relates to a variable displacement vane pump used as a fluid pressure supply source.

BACKGROUND ART

In a variable displacement vane pump, a cam ring swings using a pin as a fulcrum so as to vary an amount of eccentricity of the cam ring relative to a rotor, and as a result, a discharge volume of a working fluid is varied.

In a variable displacement vane pump disclosed in JP2005-337146A, first and second fluid pressure chambers are provided on an outer periphery of a cam ring, and the cam ring swings in accordance with a differential pressure between the first and second fluid pressure chambers.

A seal housing groove opposing the outer periphery of the cam ring is formed in an adapter ring that houses the cam ring, and a seal member is inserted into the seal housing groove. The seal member partitions the first and second fluid pressure chambers by coming into sliding contact with the outer periphery of the cam ring.

This type of seal member is constituted by a resin slipper seal that comes into sliding contact with the outer periphery of the cam ring, and a rubber elastic member that presses the slipper seal against the outer periphery of the cam ring.

Space is limited inside the variable displacement vane pump, and therefore the size of an opening cross-section (a groove depth) of the seal housing groove formed in the adapter ring is limited. Hence, the slipper seal is formed in a flat, thin plate shape having a rectangular cross-section so that space for inserting the elastic member is secured in the seal housing groove behind the slipper seal.

SUMMARY OF INVENTION

Since the slipper seal disclosed in JP2005-337146A is formed in a thin plate shape having a rectangular cross-section, the slipper seal may be incorporated into the seal housing groove in an incorrect direction during assembly. When the slipper seal is incorporated incorrectly in this manner, a sealing performance between the first and second fluid pressure chambers is impaired.

An object of the present invention is to prevent incorrect incorporation of a slipper seal into a variable displacement vane pump.

According to one aspect of the present invention, a variable displacement vane pump used as a fluid pressure supply source includes a rotor that is driven to rotate, a plurality of vanes inserted into the rotor to be free to slide, a cam ring that has an inner peripheral cam surface with which a tip end of the vanes comes into sliding contact, and can be offset from a center of the rotor, a pump chamber defined between the rotor, the cam ring, and adjacent vanes, a cam ring housing member that defines a first fluid pressure chamber and a second fluid pressure chamber relative to an outer periphery of the cam ring, the cam ring being moved relative to the rotor by a differential pressure between the first fluid pressure chamber and the second fluid pressure chamber, a seal housing groove formed in an inner periphery of the cam ring housing member, and a slipper seal which is inserted into the seal housing groove and comes into sliding contact with the outer periphery of the cam ring so as to partition the first fluid pressure chamber from the second fluid pressure chamber when the cam ring moves. The slipper seal is formed in a thin plate shape having a square cross-section.

DESCRIPTION OF EMBODIMENTS

An embodiment of the present invention will be described below with reference to the figures.

Figure 1:
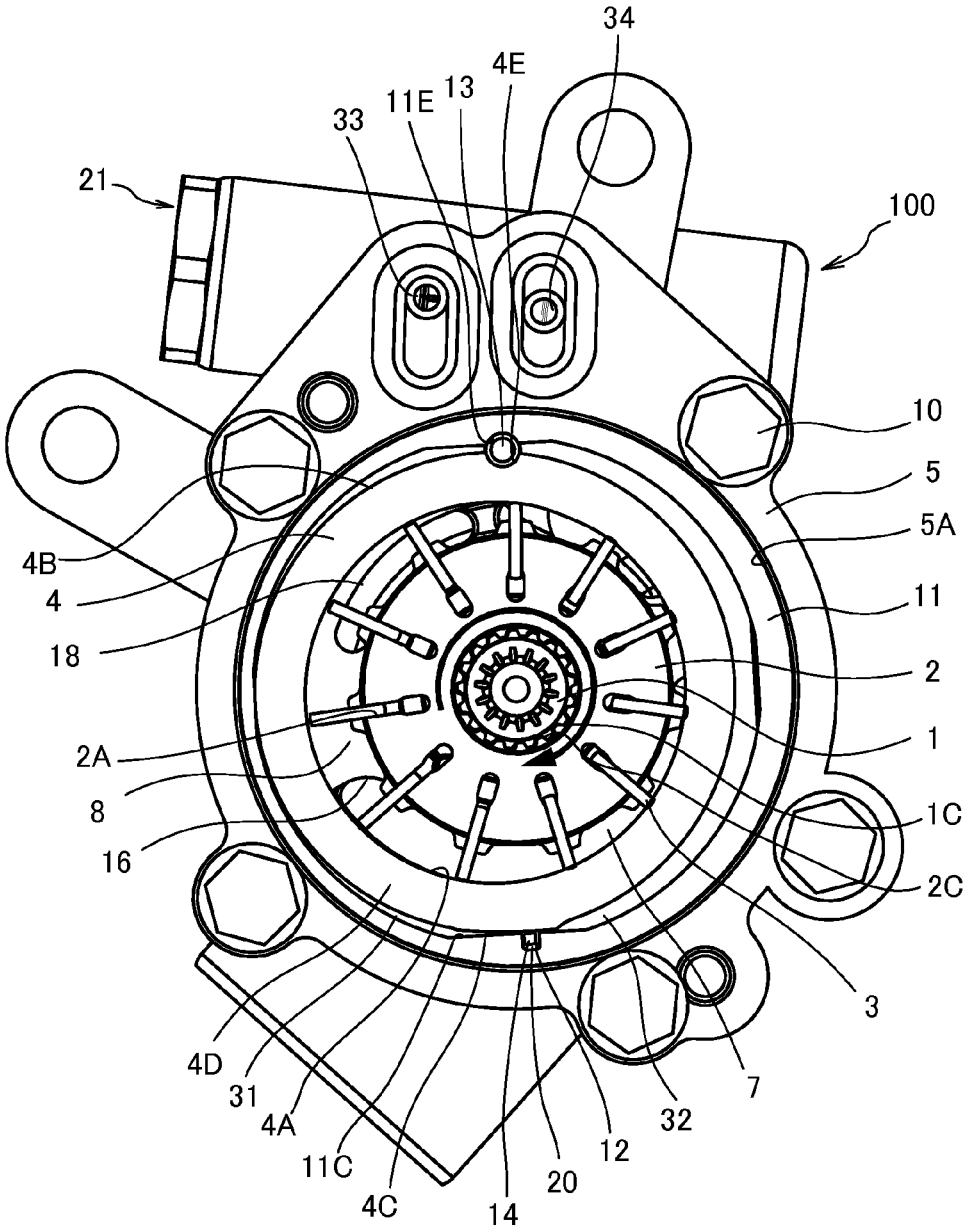
FIG. 1 is a front view showing a variable displacement vane pump according to an embodiment of the present invention.

Referring to FIG. 1, a variable displacement vane pump 100 according to an embodiment of the present invention will be described.

The variable displacement vane pump (referred to simply as the "vane pump" hereafter) 100 is used as an oil pressure (fluid pressure) supply source for a hydraulic device (a fluid pressure device) installed in a vehicle, such as a power steering apparatus or a continuously variable transmission, for example. The vane pump 100 may also be used as a fluid pressure supply source for another device or piece of equipment.

A configuration by which the vane pump 100 discharges working fluid will be described below. Note that working oil is used in the vane pump 100 as the working fluid, but a working fluid such as a water-soluble replacement fluid, for example, may be used instead of working oil.

In the vane pump 100, when power from an engine (not shown) is transmitted to a drive shaft 1, a rotor 2 coupled to the drive shaft 1 rotates. In FIG. 1, the rotor 2 rotates clockwise, as shown by an arrow.

The vane pump 100 includes, as a pump mechanism for pressurizing the working fluid, the rotor 2, a plurality of vanes 3 that reciprocate in a radial direction of the rotation of the rotor 2, and a cam ring 4 that houses the rotor 2 and the vanes 3.

The rotor 2 is formed in an annular shape. A plurality of slits 2A are formed radially in the rotor 2 at fixed intervals. A spline 2C is formed on an inner periphery of the rotor 2, and a spline 1C of the drive shaft 1 is fitted to the spline 2C.

The vanes 3 are respective formed in a substantially rectangular flat plate shape and inserted into the slits 2A to be free to slide.

The cam ring 4 is formed in an annular shape. A cylindrical surface-shaped inner peripheral cam surface 4A is formed on an inner periphery of the cam ring 4. As the rotor 2 rotates, tip ends of the vanes 3 come into sliding contact with the inner peripheral cam surface 4A.

A plurality of pump chambers 7 are defined inside the cam ring 4 by an outer periphery of the rotor 2, inner peripheral cam surface 4A of the cam ring 4, and the adjacent vanes 3.

The vane pump 100 includes a pump body 5 and a pump cover (not shown) as a casing. FIG. 1 shows a disassembled condition in which the pump cover is removed from the pump body 5. The pump body 5 and the pump cover are fastened via a plurality of bolts 10. The drive shaft 1 is supported by the pump body 5 and the pump cover via a bearing (not shown) to be free to rotate.

A pump housing recessed portion 5A for housing the pump mechanism is formed in the pump body 5. A side plate 8 that contacts one side portion of the rotor 2 and the cam ring 4 is disposed on a bottom surface of the pump housing recessed portion 5A. An opening portion of the pump housing recessed portion 5A is sealed by the pump cover, which contacts another side portion of the rotor 2 and the cam ring 4. The pump cover and the side plate 8 are disposed so as to sandwich respective side faces of an adapter ring 11, the rotor 2, and the cam ring 4.

The adapter ring 11 is provided as a cam ring housing member that houses the cam ring 4. By interposing the adapter ring 11 between the pump cover and the side plate 8, a gap extending from the pump cover and side plate 8 to the rotor 2 and cam ring 4 is formed precisely.

An intake port 16 that leads the working fluid into the pump chambers 7 and a discharge port 18 that extracts the working fluid from the pump chambers 7 and leads the extracted working fluid to an external fluid pressure device are formed in the side plate 8. The intake port 16 communicates with a tank (not shown) via an intake passage (not shown). The discharge port 18 communicates with the fluid pressure device via a pump discharge passage (not shown).

During an operation of the vane pump 100, in an intake region of the cam ring 4, the vanes 3 coming into sliding contact with the inner peripheral cam surface 4A project from the rotor 2 such that the pump chambers 7 expand, and as a result, the working fluid in the tank is suctioned from the intake port 16 into the pump chambers 7 through the intake passage. In a discharge region of the cam ring 4, on the other hand, the vanes 3 coming into sliding contact with the inner peripheral cam surface 4A are pushed into the rotor 2 such that the pump chambers 7 contract, and as a result, the pressurized working fluid in the pump chambers 7 is supplied to the fluid pressure device from the discharge port 18 through the pump discharge passage.

A configuration for varying a discharge volume (a displacement volume) of the vane pump 100 will now be described.

The adapter ring 11 and the cam ring 4 are housed in the pump housing recessed portion 5A of the pump body 5. A support pin 13 is interposed between the adapter ring 11 and the cam ring 4. The support pin 13 is positioned by inserting respective end portions thereof into holes (not shown) provided respectively in the side plate 8 and the pump cover. An engagement recessed portion 11E that engages with the support pin 13 is formed in an inner periphery of the adapter ring 11. When the engagement recessed portion 11E engages with the support pin 13, the adapter ring 11 is positioned in a circumferential direction. An engagement recessed portion 4E that engages with the support pin 13 is formed in an outer periphery of the cam ring 4. The cam ring 4 swings on an inner side of the adapter ring 11 using the support pin 13 as a fulcrum so as to be offset from a center of the rotor 2.

A slipper seal 14 to be described below is interposed between the outer periphery of the cam ring 4 and the inner periphery of the adapter ring 11. When the cam ring 4 swings, the slipper seal 14 comes into sliding contact with the outer periphery of the cam ring 4. A first fluid pressure chamber 31 and a second fluid pressure chamber 32 are defined between the outer periphery of the cam ring 4 and the inner periphery of the adapter ring 11 by the slipper seal 14 and the support pin 13.

The vane pump 100 includes a control valve 21 that controls a pressure of the working fluid led into the first fluid pressure chamber 31 and the second fluid pressure chamber 32. A first fluid pressure passage 33 that communicates with the first fluid pressure chamber 31, a second fluid pressure passage 34 that communicates with the second fluid pressure passage 32, a drain passage (not shown) that communicates with the tank, and the pump discharge passage (not shown) are respectively connected to the control valve 21.

The cam ring 4 swings about the support pin 13 in accordance with a pressure balance between the first fluid pressure chamber 31, the second fluid pressure chamber 32, and the pump chambers 7, which is controlled by the control valve 21. When the cam ring 4 swings, an amount of eccentricity of the cam ring 4 relative to the rotor 4 varies, leading to variation in the discharge volume of the pump chambers 7. When the cam ring 4 swings in a rightward direction in FIG. 1, the amount of eccentricity of the cam ring 4 relative to the rotor 2 decreases, leading to a reduction in the discharge volume of the pump chambers 7. When the cam ring 4 swings in a leftward direction in FIG. 1, on the other hand, the amount of eccentricity of the cam ring 4 relative to the rotor 2 increases, leading to an increase in the discharge volume of the pump chambers 7.

A configuration by which the slipper seal 14 partitions the first fluid pressure chamber 31 from the second fluid pressure chamber 32 will now be described.

A cylindrical outer peripheral surface 4B and a seal sliding surface 4C with which the slipper seal 14 comes into sliding contact are provided on the outer periphery of the cam ring 4. The seal sliding surface 4C is formed in a cylindrical surface shape centering on the support pin 13. It should be noted that the seal sliding surface 4C is not limited to this shape, and may be designed as desired in accordance with specifications.

A cam ring opposing portion 11C that opposes the seal sliding surface 4C of the cam ring 4 is provided on the inner periphery of the adapter ring 11. A seal housing groove 12 is formed in a central portion of the cam ring opposing portion 11C. The seal housing groove 12 is formed to extend in a rotary axis direction of the rotor 2 and traverse linearly the cam ring opposing portion 11C. By providing the cam ring opposing portion 11C, a thickness required to form the seal housing groove 12 is secured in the cam ring 4. The cam ring opposing portion 11C is formed in a planar shape. It should be noted that the cam ring opposing portion 11C is not limited to this shape, and may be designed as desired in accordance with specifications.

Figure 2:
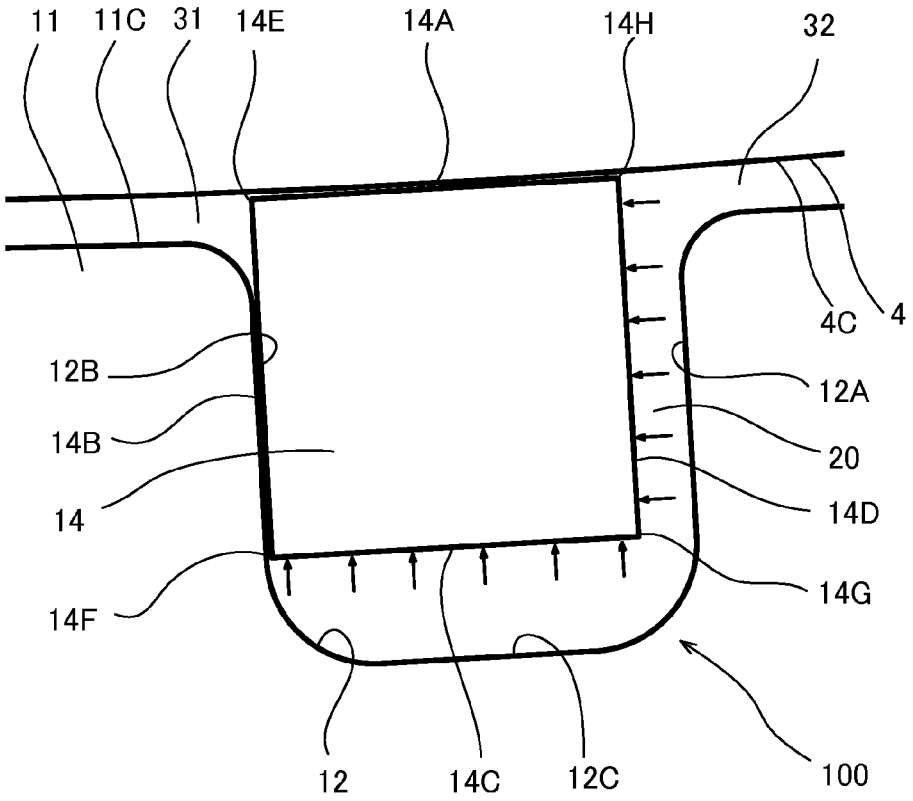
FIG. 2 is an enlarged front view showing a part of the variable displacement vane pump.

FIG. 2 is a front view showing the vicinity of the seal housing groove 12. The seal housing groove 12 includes first and second groove side portions 12A, 12B that sandwich the slipper seal 14 and extend in an axial direction while opposing each other, and a groove bottom portion 12C that is positioned behind the slipper seal 14, i.e. on an opposite side of the cam ring 4 across the slipper seal 14, and extends in the axial direction.

The first and second groove side portions 12A, 12B respectively include sites that extend parallel to each other in a planar shape, sites that are connected to the cam ring opposing portion 11C and extend in a curved surface shape, and sites that are connected to the groove bottom portion 12C and extend in a curved surface shape.

The slipper seal 14 is formed in a thin plate shape having a square cross-section. The slipper seal 14 includes first to fourth seal surfaces 14A to 14D extending in the axial direction, and first to fourth corner portions 14E to 14H connecting adjacent seal surfaces of the first to fourth seal surfaces 14A to 14D to each other.

The first to fourth seal surfaces 14A to 14D are formed in a planar shape such that adjacent seal surfaces are orthogonal to each other. The first to fourth seal surfaces 14A to 14D have equal widths (dimensions in a direction perpendicular to a lengthwise direction).

The first to fourth corner portions 14E to 14H are sites having a right angle-shaped cross-section and respectively connecting adjacent seal surfaces of the first to fourth seal surfaces 14A to 14D to each other. It should be noted that the first to fourth corner portions 14E to 14H are not limited to a right angle-shaped cross-section, and may be shaped such that adjacent seal surfaces of the first to fourth seal surfaces 14A to 14D are connected to each other by curved surfaces.

It should be noted that in the specification and the claims, a square shape denotes a shape in which distances (a width of the slipper seal 14) between respective sides extending parallel to each other from among the four sides are equal, and does not necessarily indicate a shape having right-angled corner portions.

The slipper seal 14 is formed by molding a resin material into a thin plate shape. The material of the slipper seal 14 is set as desired in accordance with requirements such as a modulus of elasticity and a frictional coefficient.

An opening width and a depth of the seal housing groove 12 are formed to be larger than the width of the slipper seal 14 by an opening width of a seal housing groove inner gap 20. As a result, the seal housing groove inner gap 20 is defined between the seal housing groove 12 and the slipper seal 14.

An elastic member or the like is not provided between the groove bottom portion 12C of the seal housing groove 12 and the slipper seal 14. Accordingly, the slipper seal 14 is inserted movably into the seal housing groove 12 on an inner side of the seal housing groove inner gap 20.

An operation by which the slipper seal 14 partitions the first fluid pressure chamber 31 from the second fluid pressure chamber 32 will now be described.

FIG. 2 shows a condition during an operation in which a working fluid pressure in the second fluid pressure chamber 32 is higher than a working fluid pressure in the first fluid pressure chamber 31 (i.e. when the rotor 2 rotates at low speed). In this operating condition, the slipper seal 14 moves in a leftward direction of FIG. 2 in accordance with a working fluid pressure difference between the first fluid pressure chamber 31 and the second fluid pressure chamber 32, whereby the seal housing groove inner gap 20, which has an L-shaped cross-section, is defined between the slipper seal 14 and the seal housing groove 12 on a right side and a lower side of the slipper seal 14. Accordingly, the working fluid pressure in the second fluid pressure chamber 32 passes through the seal housing groove inner gap 20 so as to act on the third and fourth seal surfaces 14C, 14D of the slipper seal 14, as shown by arrows in the figure. As a result, the second seal surface 14B is pressed against the second groove side portion 12B of the seal housing groove 12, and the first seal surface 14A is pressed against the seal sliding surface 4C of the cam ring 4.

Figure 3:
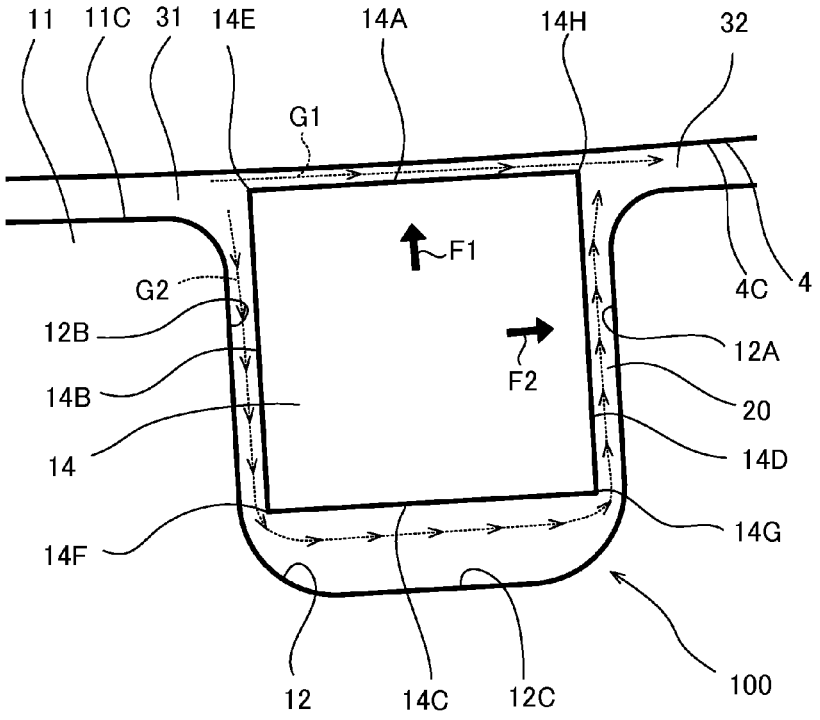
FIG. 3 is a front view showing an operation of the variable displacement vane pump.

FIG. 3 shows a condition during a switching operation in which the working fluid pressure in the first fluid pressure chamber 31 is higher than the working fluid pressure in the second fluid pressure chamber 32. When, immediately after the working fluid pressure is switched, the first seal surface 14A of the slipper seal 14 separates from the seal sliding surface 4C of the cam ring 4, the working fluid flows from the first fluid pressure chamber 31 around the slipper seal 14 into the second fluid pressure chamber 32, as shown by arrows G1, G2 in FIG. 3. The working fluid indicated by the arrow G1 flows rectilinearly between the first seal surface 14A and the seal sliding surface 4C, and therefore, in comparison with the working fluid indicated by the arrow G2, a flow passage resistance exerted thereon is small, whereby a flow speed thereof is high and the working fluid pressure thereof is low. Accordingly, the slipper seal 14 is caused to approach and pressed against the seal sliding surface 4C of the cam ring 4 by the working fluid pressure difference acting on the first and third seal surfaces 14A, 14C, as shown by an arrow F1. The slipper seal 14 is then moved in a rightward direction of FIG. 3 by the working fluid pressure difference between the first fluid pressure chamber 31 and the second fluid pressure chamber 32, as shown by an arrow F2, such that the fourth seal surface 14D is pressed against the first groove side portion 12A of the seal housing groove 12.

Thus, the working fluid pressure in the first fluid pressure chamber 31 and the second fluid pressure chamber 32 is led into the seal housing groove inner gap 20 defined between the seal housing groove 12 and the slipper seal 14. The slipper seal 14 is pressed against the seal sliding surface 4C of the cam ring 4 and the second groove side portion 12B or the first groove side portion 12A of the seal housing groove 12 by the working fluid pressure difference between the first fluid pressure chamber 31 and the second fluid pressure chamber 32. As a result, the slipper seal 14 is sealed between the first fluid pressure chamber 31 and the second fluid pressure chamber 32.

Here, a vane pump 200 according to a comparative example will be described.

Figure 4:
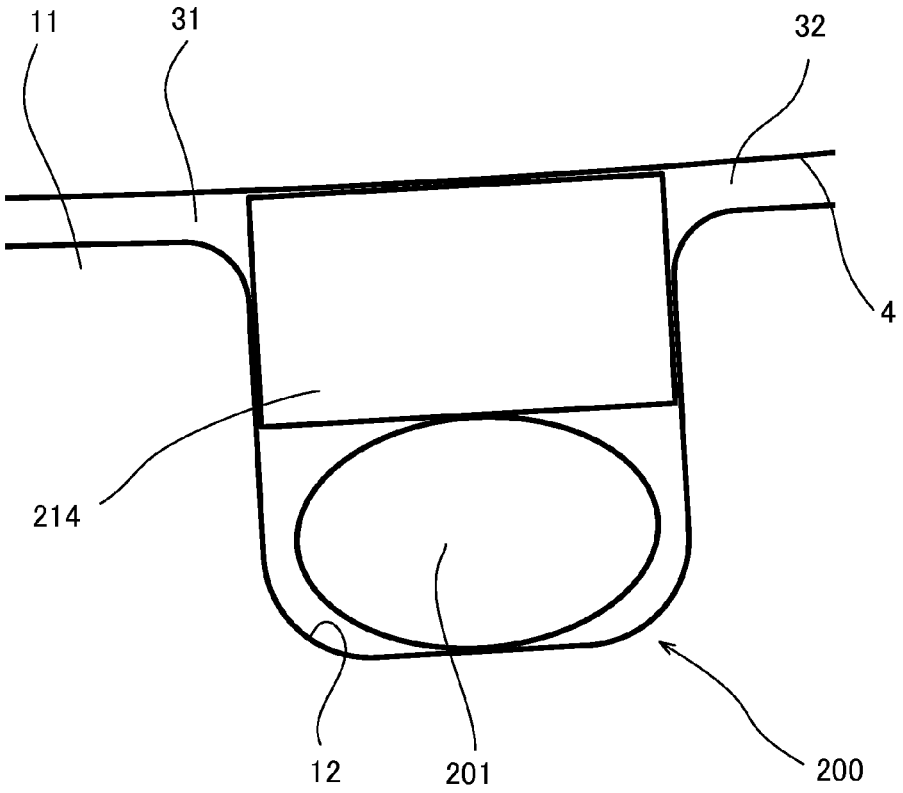
FIG. 4 is a front view showing a part of a variable displacement vane pump according to a comparative example.

FIG. 4 is a front view showing the vicinity of the seal housing groove 12 in the variable displacement vane pump 200 according to the comparative example.

In the vane pump 200 according to the comparative example, a resin slipper seal 214 and a rubber elastic member 201 are inserted into the seal housing groove 12. The slipper seal 214 is pressed against the outer periphery of the cam ring 4 by an elastic restoring force of the elastic member 201, and thereby sealed between the first fluid pressure chamber 31 and the second fluid pressure chamber 32.

The slipper seal 214 is formed in a flat, thin plate shape having a rectangular cross-section. Accordingly, a space for inserting the elastic member 201 is secured in the seal housing groove 12 behind the slipper seal 214.

Since the slipper seal 214 is formed in a thin plate shape having a rectangular cross-section, however, the slipper seal 214 may be incorporated into the seal housing groove 12 in an incorrect direction during assembly of the vane pump 200. When the slipper seal 214 is incorporated incorrectly in this manner, a sealing performance between the first fluid pressure chamber 31 and the second fluid pressure chamber 32 is impaired.

According to this embodiment, in contrast to the comparative example described above, following actions and effects are obtained.

(1) In the variable displacement vane pump 100 according to this embodiment, there are no limitations on the direction in which the slipper seal 14 having a square cross-section is incorporated into the seal housing groove 12. Therefore, incorrect incorporation of the slipper seal 14 into the seal housing groove 12 during assembly can be prevented, and as a result, impairment of the sealing performance between the first and second fluid pressure chambers 31, 32 can be avoided.

(2) In the variable displacement vane pump 100 according to this embodiment, the seal housing groove inner gap 20 is defined between the seal housing groove 12 and the slipper seal 14, and the working fluid pressure that presses the slipper seal 14 against the outer periphery of the cam ring 4 is led through the seal housing groove inner gap 20 from the first fluid pressure chamber 31 or the second fluid pressure chamber 32. In other words, the slipper seal 14 moves through the seal housing groove inner gap 20 so as to be pressed against the outer periphery of the cam ring 4 in accordance with the fluid pressure difference between the first fluid pressure chamber 31 and the second fluid pressure chamber 32. As a result, the sealing performance between the first fluid pressure chamber 31 and the second fluid pressure chamber 32 is secured.

Hence, in the variable displacement vane pump 100 according to this embodiment, an elastic member for pressing the slipper seal 14 against the outer periphery of the cam ring 4 is not provided in the seal housing groove 12. By doing away with the elastic member, the slipper seal 14, which is thicker than the slipper seal 214 according to the comparative example, can be inserted into the seal housing groove 12 without the need to form the seal housing groove 12 to be deeper than that of the comparative example. As a result, there is no need to increase the size of the cam ring housing member (the adapter ring 11) onto which the seal housing groove 12 opens.

Embodiments of this invention were described above, but the above embodiments are merely examples of applications of this invention, and the technical scope of this invention is not limited to the specific constitutions of the above embodiments.

This application claims priority based on Japanese Patent Application No. 2012-216353 filed with the Japan Patent Office on Sep. 28, 2012, the entire contents of which are incorporated into this specification.

The invention claimed is:

1. A variable displacement vane pump configured as a fluid pressure supply source, the variable displacement vane pump comprising:

a rotor configured to be driven to rotate;

a plurality of vanes inserted into the rotor;

a cam ring that has an inner peripheral cam surface with which a tip end of each of the plurality of vanes comes into sliding contact, the cam ring being offset from a center of the rotor;

a pump chamber defined between the rotor, the cam ring, and adjacent vanes among the plurality of vanes;

a cam ring housing member that defines, together with an outer periphery of the cam ring, a first fluid pressure chamber and a second fluid pressure chamber, the cam ring being configured to move relative to the rotor by a differential pressure between the first fluid pressure chamber and the second fluid pressure chamber;

a seal housing groove formed in an inner periphery of the cam ring housing member; and a slipper seal which is inserted into the seal housing groove and comes into sliding contact with the outer periphery of the cam ring, the slipper seal being configured to partition the first fluid pressure chamber from the second fluid pressure chamber when the cam ring moves, wherein the slipper seal is formed in a plate shape having a square cross-section, and the slipper seal is movable in the seal housing groove in accordance with the differential pressure between the first fluid pressure chamber and the second fluid pressure chamber.

2. The variable displacement vane pump as defined in claim 1, wherein a seal housing groove inner gap through which working fluid pressure for pressing the slipper seal against the outer periphery of the cam ring is led from the first fluid pressure chamber or the second fluid pressure chamber is defined between the seal housing groove and the slipper seal.

* * * * *